United States Patent [19]

Ness

[11] 4,409,692

[45] Oct. 18, 1983

[54] SCRAPER-PROTECTOR FOR USE WITH GARBAGE DISPOSAL UNIT

[76] Inventor: Virginia V. Ness, P.O. Box 1078, Ross, Calif. 94957

[21] Appl. No.: 437,348

[22] Filed: Oct. 28, 1982

Related U.S. Application Data

[63] Continuation-in-part of Ser. No. 250,105, Apr. 4, 1981.

[51] Int. Cl.[3] ..... F03C 1/26; A47L 25/00

[52] U.S. Cl. ..... 4/286; 15/105; 15/236 R

[58] Field of Search ..... 4/286, 295, 661, DIG. 4, 4/293, 287–292, 294; 220/212; 215/228; 15/105, 104 R, 236 R, 245; 294/1 R

[56] References Cited

U.S. PATENT DOCUMENTS

| | | | |
|---|---|---|---|
| 2,021,410 | 11/1935 | Foose | 4/287 |
| 3,110,054 | 11/1963 | Askew | 15/236 R |
| 3,780,393 | 12/1973 | Gaetke | 4/295 |
| 4,268,080 | 5/1981 | Lindley | 15/105 X |
| 4,297,761 | 11/1981 | Loos | 4/295 X |

*Primary Examiner*—Stephen Marcus
*Assistant Examiner*—Kenneth S. Putnam
*Attorney, Agent, or Firm*—Owen, Wickersham & Erickson

[57] ABSTRACT

A garbage-disposal scraper-protector for use with a garbage disposal unit under a sink. A disk fits loosely in a lower portion of the drain opening of the sink and provides a plurality of narrow openings enabling water to flow at all times from the sink into the garbage disposal unit. A stem extends up from the top of the disk and a handle cross-member extends horizontally across the upper end of the stem. The cross-member is long enough to bridge the drain opening and prevent the disk from dropping below the drain opening. A short, flexible scraper is secured to and extends down from the bottom of the disk a distance only slightly below the drain opening and well above the operating portions of the garbage disposal unit. The entire scraper-protector is preferably a single integral molded member of plastic.

8 Claims, 5 Drawing Figures

FIG. 1
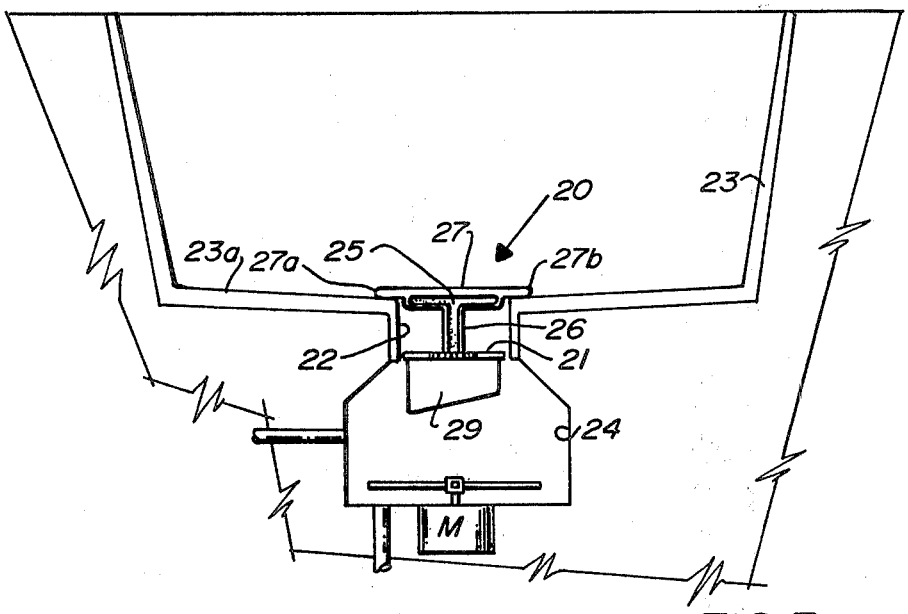
FIG. 2
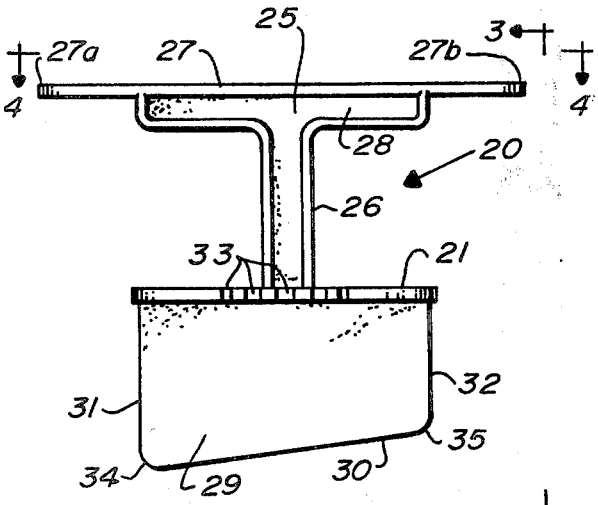
FIG. 3
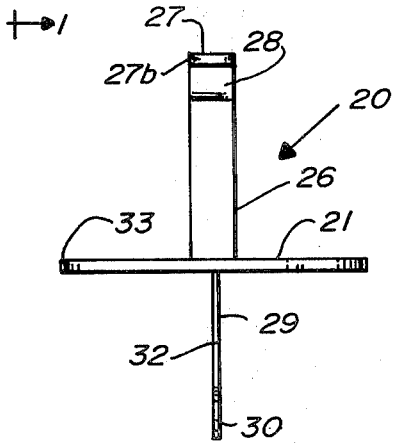
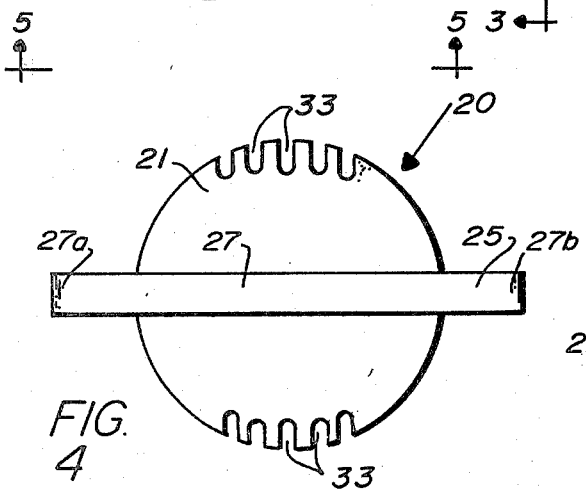
FIG. 4
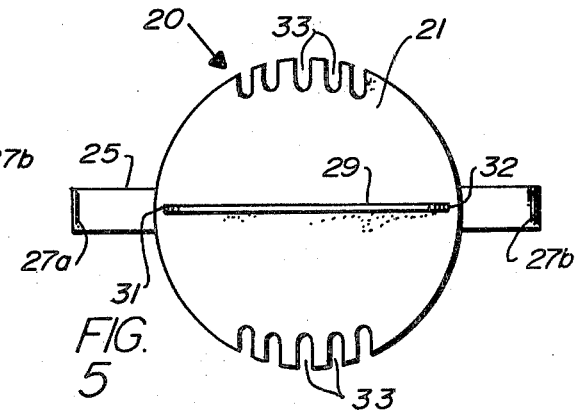
FIG. 5

SCRAPER-PROTECTOR FOR USE WITH GARBAGE DISPOSAL UNIT

REFERENCE TO RELATED PATENT APPLICATION

This invention is a continuation-in-part of application Ser. No. 250,105, filed Apr. 4, 1981, now abandoned.

BACKGROUND OF THE INVENTION

The present invention relates to a scraper-protector for use with a garbage disposal unit.

A garbage disposal unit is a mechanical device having a motor and a set of blades inside a housing installed beneath a sink drain opening as a part of the drain plumbing. Garbage passes through the sink drain opening into the garbage disposal unit, and, when the motor is started, the blades grind the particles into pieces small enough to be carried away by water through the plumbing system.

Such garbage disposal units possess apparent and well known advantages, but they also have given rise to several serious problems. For one thing, when washing or rinsing kitchen and dining implements, a spoon, fork, or similar object has often fallen down through the sink drain opening into the garbage disposal unit. When such a fall was unobserved and the unit was turned on, the object was mutilated and the blades of the disposal unit were damaged. Even when the fall was observed, retraction and recovery of the implement has usually been difficult and time consuming and, unless done carefully, dangerous.

Another problem has been that of splash-back, for many garbage disposal units have, during operation, sent fountains of water and garbage, including large pieces of material, flying up through the sink drain opening, sometimes into the face of the user. Splash-back has always been messy and inconvenient; sometimes it has been dangerous.

A further problem has been that of getting the garbage from the sink into the drain opening and from there into the garbage disposal unit, especially when the installation includes rubber fingers at the top of the disposal unit. There has been no really convenient and suitable tool for doing this. Some people have used their hands; some have used brushes or rags, which have themselves sometimes fallen into the disposal unit and resulted not only in their loss or damage, but have tended to damage the blades of the garbage disposal unit.

Such a scraper should be readily available. Sometimes, for example, a spatula normally used for cooking has also been used for scraping duty, but the spatula is not normally at hand. Furthermore, scraping tends to damage or degrade a good piece of cooking equipment, even if it does not fall into the garbage disposal unit. There is, therefore, a need for a readily available, sturdy, easy-to-use scraper. Preferably, such a scraper would be normally in the sink and have other uses when not being used for scraping.

The use of solid drain cover or stopper, of the type normally used to seal off a drain opening when filling the sink with water, has not solved these problems. Water must be able to flow into and through the garbage disposal disposal unit when the unit is being operated and also when the sink is used for peeling vegetables with running water. A stopper obstructs the flow of water into the drain and is somewhat difficult to remove when the sink is full, or even partially filled, especially when it contains very hot water. Leaving a solid stopper slightly ajar can permit water to flow into the drain while the opening remains substantially protected. However, such placement and alignment of the stopper is often difficult, and the stopper tends to slip into its completely sealed position or into a more open position than is desired. Moreover, projections extending up from the stopper can provide an obstruction in the sink that interferes with use of the sink.

A common attempt to solve the problems described above has been to place in the drain hole a rubber stopper having a plurality of fingers emanating from the center of the stopper. However, such a stopper, while keeping some foreign objects out of the garbage disposal unit does not bar the passage of items having significant weight, such as silverware, which is heavy enough, if dropped, to depress the rubber fingers and fall right into the disposal unit. This attempt has, therefore, been unsuccessful at protecting either the implements or blades of the disposal unit and has been primarily useful only in preventing splash back of objects that would otherwise be split out of the disposal unit while it is being operated.

The Loos U.S. Pat. No. 4,297,761, attempts to solve some of these problems by providing a combination scraper and sink plug. When the Loos device is being used as a plug, water is unable to flow from the sink into the garbage disposal unit, as it should during operation of the unit. Moreover, the Loos scraper blade is very long, reaching down to a level just above the garbage disposal unit blades when the plug is in place. Such a scraper, (if the plug is used during operation of the blades) is certain to be damaged by some of the flying pieces of garbage lying just above the blades and also to interfere with the blades' grinding action. The use of such a scraper as a pusher is thus generally undesirable and may even aggravate the problems. The Loos patent suggests, but does not illustrate or adequately describe, a modified device that would permit water flow around or through the plug portion, but the patent offers no suggestion of how to prevent the modified device from falling through into the disposal unit. Support from below cannot safely be relied on, and there is no other possible support implied. Moreover, in either form of this device the upstanding handle projects a substantial distance up into the sink, so that one would not be able to hold a pot or pan flat on the sink bottom when the Loos plug is in place.

Another device, shown in Gaetke U.S. Pat. No. 3,780,393 also provides a scraper with a long depending blade that would tend to interfere with the action of the disposal blades, even whether or not it actually engages them. This device provides no protection against splash-back nor prevention of passage of implements and silverware down into the disposal unit. An upstanding handle, intended to prevent the Gaetke scraper from falling through the sink drain opening and down into the disposal unit, extends up too far and becomes an undesirable obstruction in the sink, preventing pots and pans from being put into the sink with their bottoms truly horizontal.

A device is needed which accomplishes the purposes already referred to and solves the problems that have been discussed.

OBJECTS OF THE INVENTION

One object of the invention is to provide a device for protecting the inlet into a garbage disposal unit, for keeping foreign objects out of the disposal unit and yet at the same time enabling water to flow from the sink into the drain.

Another object of the invention is to provide a garbage disposal unit protector which is easily put in place, easily kept in place, and easily removed.

Another object is to provide a device for preventing splash back from a garbage disposal unit into and above the sink, whether the splash back is water only, or includes chunks or objects impelled upwardly by the unit's blades.

Yet another object of the invention is to provide a garbage disposal unit protector which may also be used to scrape debris into the garbage disposal unit while at the same time providing a scraper which is normally at hand when wanted.

Another object is to accomplish the above objects without resulting in a substantial projection up into the working area of the sink.

A further object of the invention is to provide a garbage disposal unit protector satisfying the foregoing objects while still being economical to manufacture and sturdy in use.

SUMMARY OF THE INVENTION

The invention provides a garbage disposal protector and a garbage scraper for use in a sink. A circular disk, adapted to fit in the drain opening of a sink, incorporates openings or slots through which water can flow through the drain into the garbage disposal unit. The protector-scraper also has a handle extending upwardly from the disk and terminating in a substantially flat cross member that prevents the scraper-protector from falling through the sink drain into the garbage disposal unit. The scraper-protector has a short depending angled scraping blade extending downwardly a short distance below the disk, enabling one to scrape the sink while insuring that there will be no interference by the scraping blade while the device is in place.

BRIEF DESCRIPTION OF THE DRAWINGS

FIG. 1 is a view in side elevation and in section of a scrper-protector embodying the principles of the invention, shown in place in the drain opening of a sink, over a garbage disposal unit, with the extremeties of the handle cross-member resting substantially flat on the bottom of the sink and preventing the scraper-protector from falling into the disposal unit.

FIG. 2 is an enlarged view in side elevation of the scraper-protector of FIG. 1.

FIG. 3 is an end view in elevation of the scraper-protector, looking along the line 3—3 in FIG. 2.

FIG. 4 is a top plan view of the scraper-protector looking along the line 4—4 in FIG. 2.

FIG. 5 is a bottom view of the same scraper-protector taken along the line 5—5 in FIG. 2.

DESCRIPTION OF THE PREFERRED EMBODIMENTS

FIGS. 1 to 5 show a scraper-protector 20 embodying the principles of the present invention. Preferably the scraper-protector 20 is an integral, molded, one-piece article made from plastic (such as polypropylene or polyethylene) or plexiglas or hard rubber, and is shaped so that some portions have the rigidity they need for their purpose while others have the flexibility which their functions require. The materials indicated are resilient, do not readily conduct heat, are inexpensive, and do not scratch a sink made of such materials as Monel metal or stainless steel.

The scraper-protector 20 has a stiff disk portion 21 adapted to fit loosely in a drain opening 22 of a sink 23. The sink 23 usually has a nearly flat bottom surface **23*a*, which slopes gently into the drain opening 22. Below the sink 23 the drain opening 22 leads down into a garbage disposal unit 24**.

A handle 25 has a stem 26 extending up from the upper surface of the disk 21 and preferably integral with it. The stem 26 is preferably flat in one direction and wide in the other to give the desired stiffness. The handle 25 preferably comprises a substantially flat, relatively wide cross-member 27 at the top with extremeties **27*a* and 27*b* at the ends that engage the sink bottom 23*a* on each side of the opening 22 and prevent the device 20 from falling through the opening 22 and down into the disposal unit 24. The cross-member 27 is flat enough not to project up any significant distance above the sink bottom 23*a* when it is in place, and it is preferably wider than it is high. A reinforcing portion 28 below the control portion of cross-member 27 imparts the needed rigidity without adding height to the cross-member 27, since the portion 28 is shorter than the cross-member 27 and fits easily and loosely down into the opening 22. The stem 26 is made just long enough so that when the portion 27 of the handle 25 lies on the sink bottom 23*a* over the drain opening 22 and where it can be easily grasped, the disk 21 is still above the bottom of the drain opening 22, and therefore prevents splash back and prevents objects from falling from above down into the disposal unit 24. Since the cross-member 27 bridges the drain 22 and cannot fall through, the entire scraper-protector is held thereby and cannot fall through such a drain opening 22**.

The handle 25 is held by the hand when removing the scraper-protector 20 from the drain opening 22 and also when the device 20 is used to scrape garbage into the opening 22. For this latter purpose, a scraper portion or blade 29, also preferably integral with the disk 21, extends down from the lower surface of the disk 21. The scraper blade 29 has a lower edge 30 which is preferably set at an angle to the plane of the disk 21, one vertical end edge 31 being longer than the other vertical end edge 32. The edges 31 and 32 meet the edge 30 at smoothly rounded corners 34 and 35. FIGS. 2, 3, and 5 show that the scraper blade 29 preferably lies in the same plane as the handle 25. The scraper blade 29 preferably does not extend out so far from center as the circumference of the disk 21, as best illustrated in FIGS. 2 and 5. There may be variations in the shape and size of the scraper blade 29 to adapt to particular uses and types of sinks, but in all cases the blade 29 is to be somewhat flexible, to have an angled lower edge 30, and to be short in the vertical direction so that it is held as far as possible above the garbage disposal unit blades when the device 20 is installed into the opening 22. The scraper blade 29 not only helps scrape the garbage into the garbage disposal unit 24, it also, when the device 20 is installed in the opening 22, helps to push the garbage so that it will go deep down into the unit 24.

In order to enable water to flow, in limited amounts, past the scraper-protector 20 and through the drain 22 into the garbage disposal unit 24, the disk 21 is provided with openings, such as slots 33 extending in from the outer edge of the disk 21. The slots 33 should be wide enough and numerous enough to permit the desired flow of water required by the disposal unit 24 into the drain 22, along with the small particles the water carries, but narrow enough to prevent implements and foreign objects which could harm the garbage disposal unit 24 or be damaged themselves, from falling into the disposal unit 24.

Thus, the device of this invention prevents splash back and the upward ejection of material from the garbage disposal unit 24 up into or above the sink 23. Further, while water can flow from the sink 23 into the unit 24, the relatively stiff disk 21 prevents utensils and flatware from dropping down into the unit 24, for it does not yield to the force of such implements falling on it. The flexible scraper blade 29 enables the device 20 to be used to scrape garbage into the drain passage 22, and then the device 20 can be dropped into the passage 22 to close it off from utensils and other objects while enabling the passage of water. The handle cross-member 27, stiffened and reinforced by the portion 28, prevents the disk 21 from falling below the bottom of the drain opening 22, prevents the short blade 29 from interfering in any way with the action of the unit 24 (for it is always spaced high above the blades of the unit 24), and of course prevents the device 20 from falling all the way into the unit 24, no matter how it is placed or dropped. Moreover, the stem 26 insures that the disk 21 will be properly positioned in the opening 22, and since the handle cross-member 27 is flat, it does not project up into the sink 23 but rather hugs the nearly flat bottom surface 23*a* of the sink 23.

With this device, the rubber flanges and fingers installed in some sink drains to prevent splashback can be removed or discarded.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

I claim:

1. A garbage-disposal scraper-protector for use with a garbage disposal unit and a sink having a generally cylindrical drain opening leading to said garbage disposal unit, comprising:

a disk adapted to fit loosely in a lower portion of the drain opening of the sink and providing a plurality of narrow openings enabling water to flow at all times from said sink into said garbage disposal unit, while preventing the passage of silverware and kitchen implements into said garbage disposal unit, a handle having a narrow stem extending up from the top of said disk and a thin, narrow, flat cross-member extending horizontally across the upper end of said stem and long enough to bridge said drain opening and provide the sole support for said disk and prevent said disk from falling through said drain opening, while the flatness of said cross-member enables the cross-member to lie at substantially the level of the sink around said drain opening, and a short, flexible scraper secured to and extending down from the bottom of said disk a distance only slightly below said drain opening and well above the operating portions of said garbage disposal unit.

2. The scraper-protector of claim 1 wherein the entire scraper-protector is one integral molded member of plastic possessing substantial rigidity where thick, being thick at said disk, stem, and handle, and flexible where thin, at said scraper.

3. The scraper-protector of claim 1 wherein said handle includes a reinforcing portion underlying and joined to and no wider than said handle cross-member and shorter in length so that reinforcing portion fits loosely within said drain opening below the level of the sink bottom and stiffens said cross-member.

4. The scraper-protector of claim 3 wherein said scraper, stem, and reinforcing portion lie in a common plane with said cross-member, said plane being perpendicular to said disk.

5. The scraper-protector of claim 1 wherein said scraper comprises a single short blade with one end extending farther below said disk than the other end, to provide a linear scraping edge that extends at an angle relative to the plane of said disk.

6. The scraper-protector of claim 5 wherein the blade is shorter than the diameter of the disk, extends diametrically thereacross, and is coplanar with the handle.

7. A one-piece molded scraper-protector of a plastic material comprising:

a stiff circular disk having a circumference nearly but not quite equal to the circumference of a standard sink drain opening leading into a garbage disposal unit and having a plurality of narrow slots extending in from the edge enabling the flow of water therethrough at all times while preventing the passage therethrough of table and kitchen implements, a narrow T-shaped handle thick enough to possess substantial rigidity extending up from the top of said disk and comprising a narrow vertical stem perpendicular to the disk and a narrow, thin, flat horizontal cross-member at the upper end of the stem and substantially longer from end to end than said disk, so as to bridge across said drain opening to prevent the scraper-protector from falling through the drain opening, the flatness of said cross-member enabling it to lie at substantially the level of the bottom of the sink around the upper end of the drain opening, and a scraper blade thin enough to be flexible and extending downwardly from the bottom of said disk far enough to facilitate scraping, yet shallow enough to prevent substantial entry into and interference with the operation of a garbage disposal unit when said scraper-protector is in place in a sink, said scraper blade being coplanar with said handle and shorter in length than the diameter of said disk and having a straight bottom edge between two end edges of different length, so that the bottom edge lies at an angle relative to said disk.

8. The scraper-protector of claim 7 wherein said cross-member is supported by a reinforcing member directly below it and forming part of said handle, said reinforcing member being shorter in length than said disk and shorter than the diameter of said drain opening.

* * * * *